United States Patent [19]

Whiting

[11] Patent Number: 4,637,616

[45] Date of Patent: Jan. 20, 1987

[54] MARKING PROJECTILE

[76] Inventor: Carolyn C. Whiting, 331 Trudelle Street, Unit 78, Scarborough, Ontario M1J 3J9, Canada

[21] Appl. No.: 786,069

[22] Filed: Oct. 10, 1985

[51] Int. Cl.[4] ..... A63B 37/00; A63B 67/00; A63B 71/02

[52] U.S. Cl. ..... 273/418; 273/186 D

[58] Field of Search ..... 273/58 A, 186 D, 183 C, 273/58 H, 418, 199 R, 199 A, DIG. 20, 61 R, 29 A

[56] References Cited

U.S. PATENT DOCUMENTS

| | | | |
|---|---|---|---|
| 1,504,461 | 8/1924 | Whelan | 273/DIG. 20 |
| 1,653,893 | 12/1927 | Eden | 273/199 R |
| 1,967,908 | 7/1934 | Sneary | 273/199 R |
| 2,105,861 | 1/1938 | Klecka | 273/58 A |
| 3,081,091 | 3/1963 | Grow | 273/186 D |
| 3,169,771 | 2/1965 | Holmes | 273/186 D |
| 3,190,654 | 6/1965 | Ross | 273/418 |
| 3,288,469 | 11/1966 | Shaw | 273/199 R |
| 4,065,126 | 12/1977 | Mantz | 273/58 A |

*Primary Examiner*—George J. Marlo
*Attorney, Agent, or Firm*—Ridout & Maybee

[57] ABSTRACT

A projectile for being thrown by hand and for marking its point of impact, for example for use in "survival" games has a relatively dense resiliently deformable rubber core, compressible surrounding layer loaded or impregnated with a pulverulent marking material, for example colored powdered chalk, and a flexible outer cover, which on all points of it circumference is provided with numerous perforations or apertures. The core provides the projectile with sufficient weight to enable it to be thrown accurately, and the surrounding layer cushions the impact of the core against a player who is hit by the projectile. On impact, the surrounding layer is compressed between the core and the cover, and pulverulent marker is pumped out through the perforations, and deposited on the player who is hit, thus marking the player.

9 Claims, 2 Drawing Figures

MARKING PROJECTILE

In the playing of so-called "survival" games, players or opposing teams of players patrol through a defined area of countryside, taking advantage of such cover as is available, with the object of eliminating opposing players by sighting such players and marking them with an indelible marker. In known forms of the game, the players are provided with air guns loaded with paint capsules which are fired at the opposing players and which rupture on impact and mark the player with paint. These games have proved to be enormously popular. It may be theorized that many highly successful games, for example many board games, simulate war and battle situations. The survival games are notably more realistic and truer to actual combat and thus permit much greater expression of competitive spirit. There has, however, long been concern with these games over the incidence of injuries to players who, contrary to instructions and to the rules of the game, remove protective wear, especially protective eye wear. Consideration has been given to banning such games in various legal jurisdictions, in view of the notoriously hazardous paint-marking procedures. There has thus been a need for less hazardous methods of marking an opposing player at an acceptable range, thus permitting those wishing to play these games the opportunity to enjoy the excitement and entertainment of these games in greater safety.

The present invention provides a projectile which has sufficient weight to be thrown by hand to strike an opposing player, and which is constructed so as to be relatively soft and non-injuring and to leave a mark indicative of the impact. According to the invention there is provided a projectile adapted to be thrown by hand and to mark its point of impact comprising:

(a) a relatively dense central core providing substantial mass to the projectile to permit it to be readily thrown by hand;

(b) a porous surrounding cushioning layer of relatively light compressible material;

(c) a marking material in powdered form impregnating the surrounding layer, and (d) a perforated flexible cover enclosing the surrounding layer, the cover having a plurality of perforations on all sides of the projectile so that, upon impact with a surface, a small quantity of powdered marking material will be ejected through said perforations to mark the point of impact.

By virtue of the relatively dense core the projectile can be made throwable over a substantial range e.g. 20 to 30 feet with considerable accuracy. The surrounding layer of light compressible material cushions the dense core and at least substantially reduces or completely avoids chances of injury by the projectile as compared with the risks presented by the known paint capsules fired by air guns. On impact, deformation of the flexible cover and of the compressible inner surrounding layer efficiently causes the pulverulent marking material to be pumped out through the perforations in the cover to be deposited on the targeted player, thus providing a visual indication that the player has been eliminated from further play.

Desirably, the projectile is a spherical ball, but other shapes, for example cube shapes, can be employed.

An example of a projectile of the invention is shown in the accompanying drawings, wherein.

Figure 1:
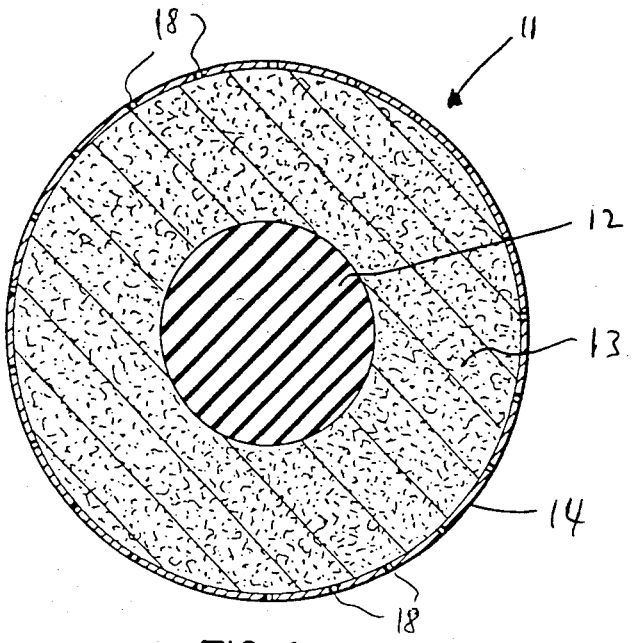
FIG. 1 is a cross-section through the centre of a ball-shaped projectile in accordance with the invention.
Figure 2:
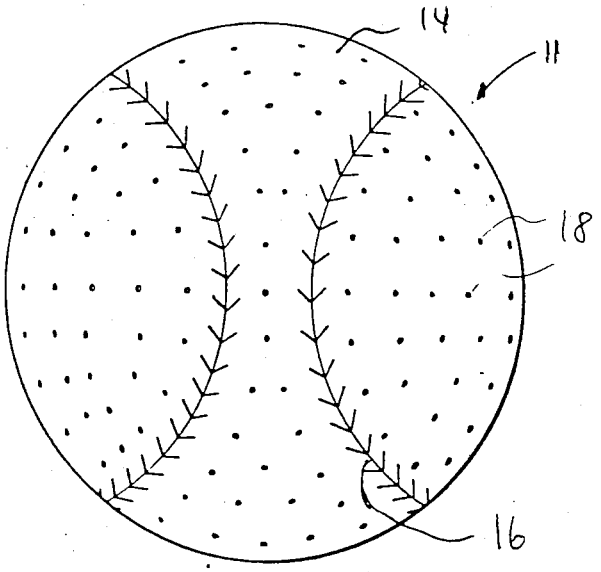
FIG. 2 is an external side view of the ball of FIG. 1.

Referring to the drawings, the ball-shape projectile 11 comprises a spherical dense core 12, a surrounding porous layer of material 13, and a perforated flexible cover 14.

The dense core 12 is desirably of rubber or some other relatively dense resiliently deformable material, so that, taken together with the layers 13 and the cover 14, it confers on the projectile a weight which is adequate to permit it to be thrown accurately over a range of e.g. about 20 to 30 feet, but which is not so rigid or dense that it is likely to present substantial risk of injuring a player hit by the projectile. Merely by way of example, it may be mentioned that, desirably, the ball will have a weight of about 1 to about 4, more preferably about 2 ounces.

One function of the surrounding layer 13 is to cushion the relatively dense core 12, so that when the ball strikes a player the mass of the relatively dense core 12 is distributed over substantially the entire portion of the surface of the ball which contacts the player. By having the surrounding layer relatively light-weight and the core relatively dense, a desirably soft-feeling impact can be achieved for the projectile, even where the projectile is of substantial mass.

The filling material 13 is porous, so that it provides interstices which permit it to be impregnated with a powdered marking material, preferably coloured chalk or talcum powder. Examples of suitable lightweight compressible porous materials for the filling layer 13 include fibrous materials, plastic foams, and granular materials. Examples of suitable fibrous materials include natural fibres, such as kapok, cotton wadding or the like, or synthetic fibres, such as polyester fibres. Various plastic foams, for example polyether foams or reticulated polyurethane foams may be employed. Desirably, the foam is open-cell, so that it can absorb large quantities of pulverent marking material, and will readily eject such pulverent marking material from its interstices on impact. Examples of suitable lightweight deformable granular materials include exfoliated vermiculite, perlite, and the like, and open-cell expanded plastic beads. In the case in which the filling layer is fibrous or granular, the filling layer material may be impregnated with the pulverent marking material by blending the fibres or granules together with the marking material to form a uniformly blended mixture. In the case in which the material of the surrounding layer is a compressible foam material, the foam material may be impregnated with the marking material by blending it with the marking material and compressing and releasing it repeatedly, so that the marking material tends to be drawn into and lodged within the pores of the foam.

The outer cover 14 should be of a material which is relatively thin and flexible, so that it is readily deformed when the projectile strikes a player, and which is sufficiently strong to withstand repeated impacts without tearing or bursting. Desirably, the cover 14 is of leather or flexible plastic, e.g. a polyvinyl film. In the case in which the projectile is spherical, as shown in the accompanying drawings, the cover 14 may consist of pieces stitched together along seams 16, in the fashion of a conventional baseball.

The cover 14 is perforated with numerous small perforations 18, which are formed through the entire surface or circumference of the cover 14, so that, regardless of which side of the projectile strikes a player, a perforated portion of the cover 14 will impact against the player.

Merely by way of example, it may be mentioned that, in the preferred form, the perforations are spaced uniformly apart over the entire surface of the cover 14 at a distance of about ½ inch apart.

In use, when the projectile forcibly strikes a player, the cover 14 is flexed inwards and the compression of the surrounding material 13 forces particles of the powdered marking material outwardly through the openings 18, thus distributing the powdered marker on the portion of the player's protective clothing or the like which is hit. On impact, the momentum of the relatively dense core 12 tends to carry this forwardly as the cover 14 is deflected inwardly, so that the portion of the surrounding layer 13 adjacent the striking surface of the cover 14 is compressed, thus tending to forcefully eject the pulverulent marker with a pumping action.

Various modifications or variations of the structure shown are, of course, possible. For example, although in the drawings the projectile is shown in the form of a spherical ball, other shapes which can conveniently be grasped in the hand and thrown can be employed. For example, the projectile may be in the form of a cube or other non-spherical form.

I claim:

1. A projectile to be thrown by hand to mark its point of impact comprising:

(a) a central core of resiliently deformable material having its density approximately that of rubber and providing substantial mass to the projectile to permit it to be readily thrown by hand;

(b) a porous surrounding cushioning layer of a compressible material relatively less dense than said core;

(c) a marking material in powdered form impregnating the surrounding layer, and (d) a perforated flexible cover enclosing the surrounding layer, the cover having a plurality of perforations on all sides of the projectile so that, upon impact with a surface, a small quantity of powdered marking material will be ejected through said perforations to mark the point of impact.

2. A projectile as claimed in claim 1 wherein the surrounding material is a fibrous material.

3. A projectile as claimed in claim 1 wherein the surrounding material is a plastic foam.

4. A projectile as claimed in claim 1 wherein the surrounding material is a granular material.

5. A projectile as claimed in claim 1, wherein the central core is rubber.

6. A projectile as claimed in claim 1 wherein the perforated cover is leather or flexible plastic.

7. A projectile as claimed in claim 1 wherein the marking material is coloured chalk.

8. A projectile as claimed in claim 1 wherein the marking material is coloured talcum powder.

9. A projectile as claimed in claim 1 which is a spherical ball.

* * * * *